US006675504B1

(12) United States Patent
Biancucci et al.

(10) Patent No.: US 6,675,504 B1
(45) Date of Patent: Jan. 13, 2004

(54) SHOE SOLE PROVIDED WITH SPIKES OR HOBNAILED MEANS

(75) Inventors: Demetrio Biancucci, Civitanova Marche (IT); Alfredo Brasca, Civitanova Marche (IT)

(73) Assignee: AL. PI. SNC di Belfiglio Luciana & C., Civitanova Marche (IT)

( * ) Notice: Subject to any disclaimer, the term of this patent is extended or adjusted under 35 U.S.C. 154(b) by 0 days.

(21) Appl. No.: 09/744,144

(22) PCT Filed: Jul. 22, 1999

(86) PCT No.: PCT/IT99/00232

§ 371 (c)(1),
(2), (4) Date: Mar. 8, 2001

(87) PCT Pub. No.: WO00/04803

PCT Pub. Date: Feb. 3, 2000

(30) Foreign Application Priority Data

Jul. 23, 1998 (IT) ..... RM98A 489

(51) Int. Cl.[7] ..... A43B 23/28
(52) U.S. Cl. ..... 36/59 R; 36/61
(58) Field of Search ..... 36/59 R, 61, 15, 36/100

(56) References Cited

U.S. PATENT DOCUMENTS

| | | | | | |
|---|---|---|---|---|---|
| 258,419 | A | * | 5/1882 | Herbert et al. | 36/61 |
| 300,006 | A | * | 6/1884 | Porter | 36/61 |
| 997,055 | A | * | 7/1911 | Gilowitz | 36/61 |
| 1,023,603 | A | * | 4/1912 | Wegmann-Eggmann | 36/61 |
| 2,776,499 | A | * | 1/1957 | Giuntini | 36/135 |
| 2,920,403 | A | * | 1/1960 | L'etoile | 36/61 |
| 2,968,878 | A | * | 1/1961 | King | 36/61 |
| 3,713,233 | A | * | 1/1973 | Hunnicutt | 36/61 |
| 3,879,864 | A | * | 4/1975 | Exley | 36/61 |
| 4,745,692 | A | * | 5/1988 | Liao | 36/61 |
| 5,269,080 | A | | 12/1993 | Davis | |

FOREIGN PATENT DOCUMENTS

| | | |
|---|---|---|
| DE | 877 870 | 5/1953 |
| JP | XP-002123727 | 4/1991 |
| JP | XP-002123726 | 3/1997 |

* cited by examiner

*Primary Examiner*—Mickey Yu
*Assistant Examiner*—Troy Arnold
(74) *Attorney, Agent, or Firm*—Young & Thompson

(57) ABSTRACT

A shoe sole (6) provided with a number of rigid spikes or nails (12) on its face in contact with the ground, said spikes or nails being not fixedly secured to the sole but being able to pass from a first extracted position in contact with the ground to a second retracted position not interfering with the trampling surface because of the combination of folding spike support means which can be overturned with first and second grooves or recesses (20) formed in the sole within which such spike support means can be accommodated in the extracted and the rest positions.

7 Claims, 3 Drawing Sheets

SHOE SOLE PROVIDED WITH SPIKES OR HOBNAILED MEANS

The present invention relates to the footwear-industry and, more specifically, the manufacturing of shoe soles provided for the use in cold countries and mountain-lands where ice and snow are steady. Under such circumstances, it is well known how hard is for everyone to keep on one's feet. Resort to the so-called hobnailed shoes, that are technical, sturdy shoes having a right weight, may be made to avoid slipping. However, the use of such shoes is not compatible with the use of everyday shoes.

To avoid resorting to hobnailed shoes, sealskins or the like were once applied under the shoes to prevent the sole from contacting the frozen ground. Based on the same principle are rubber sheathes applied in a removable way to the shoes and carrying a number of nails or spikes on the face in contact with the ground.

Such a solution, however, has the serious drawback that the user must remove the sheathes away from the shoes whenever he goes into a residence or leaves the road to enter a building in order to avoid that the nails or spikes damage the floor. It is self-evident that the operation itself is troublesome and also implies the need for the user to carry the sheathes on him until he shall put on them again.

Russian Pat. No. 2075303 discloses an antiskid device having crankshaft, holders with spines fixed on crankshaft and pair of members for retaining spines in operating and non operating position. Both retaining members are formed as bearing for roller. Sole is provided with hole for receiving spines in non operative position. The whole device is located in a large seat wherein the device can be moved from the operating position to the non operating position.

This solution however has the drawback that parts of the device are protruding from the sole of the shoes. Furthermore, the presence of a big seat formed in the thickness of the sole reduces the mechanical strength of the sole structure.

The present invention seeks to overcome the above-mentioned problems by providing a shoe sole having a number of rigid spikes or nails on its face in contact with the ground. Such spikes or nails are not fixedly secured to the sole but can pass from an extracted position in contact with the ground to a retracted position not interfering with the trampling surface because of the combination between folding spike support means which can be overturned and grooves or recesses formed in the sole within which such spike support means can be accommodated.

In a preferred embodiment this is achieved by providing spikes or nails fixedly secured to the face of the support means directed to the ground, such support means being formed of folded small bars shaped as brackets, arches or having any other geometrical shape, all of them being received within grooves or recesses formed in the thickness of the sole, as well as by also providing support means hinged at both its ends and adapted to be overturned by 180° into corresponding grooves which are mirror-like symmetrical to the preceding grooves.

In the first position the spikes or nails project from the sole by a length enough to grip the ground. In the second or rest position, the spikes or nails projecting from the small bars are accommodated in suitable recesses formed at the bottom of the grooves accommodating the small bars so that the lower surface of the shoe sole becomes flat without any projection.

Further features and advantages of the invention will be more readily apparent from the following detailed description with reference to the accompanying drawings which show some preferred embodiments of the invention only by way of a not limiting example.

Figure 1:
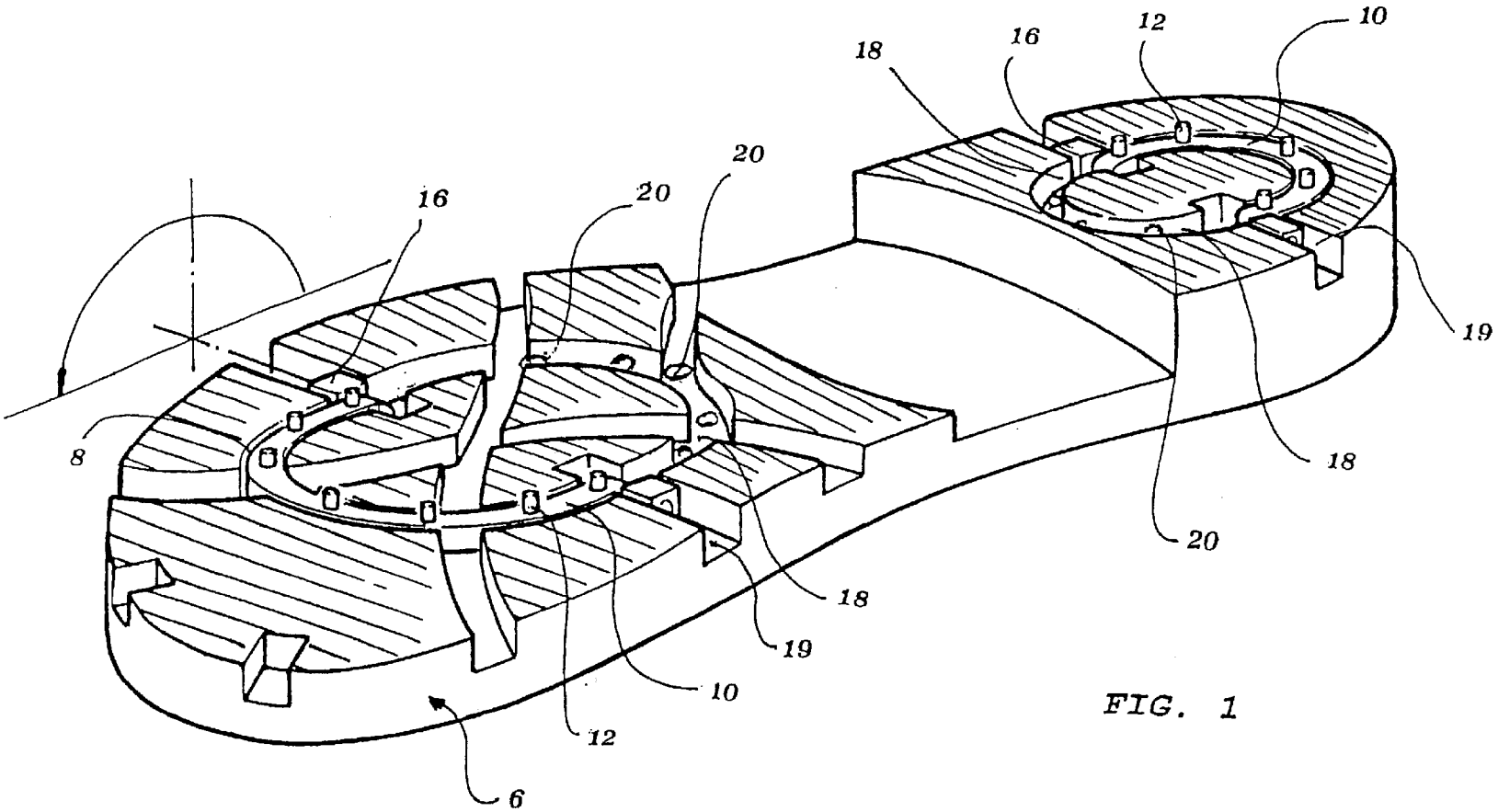
FIG. 1 shows a perspective view of the face of a shoe sole according to the invention which is in contact with the ground and is provided with spikes or nails projecting from two small arches accommodated in grooves formed in the thickness of the sole both at the tip and the heel.
Figure 2:
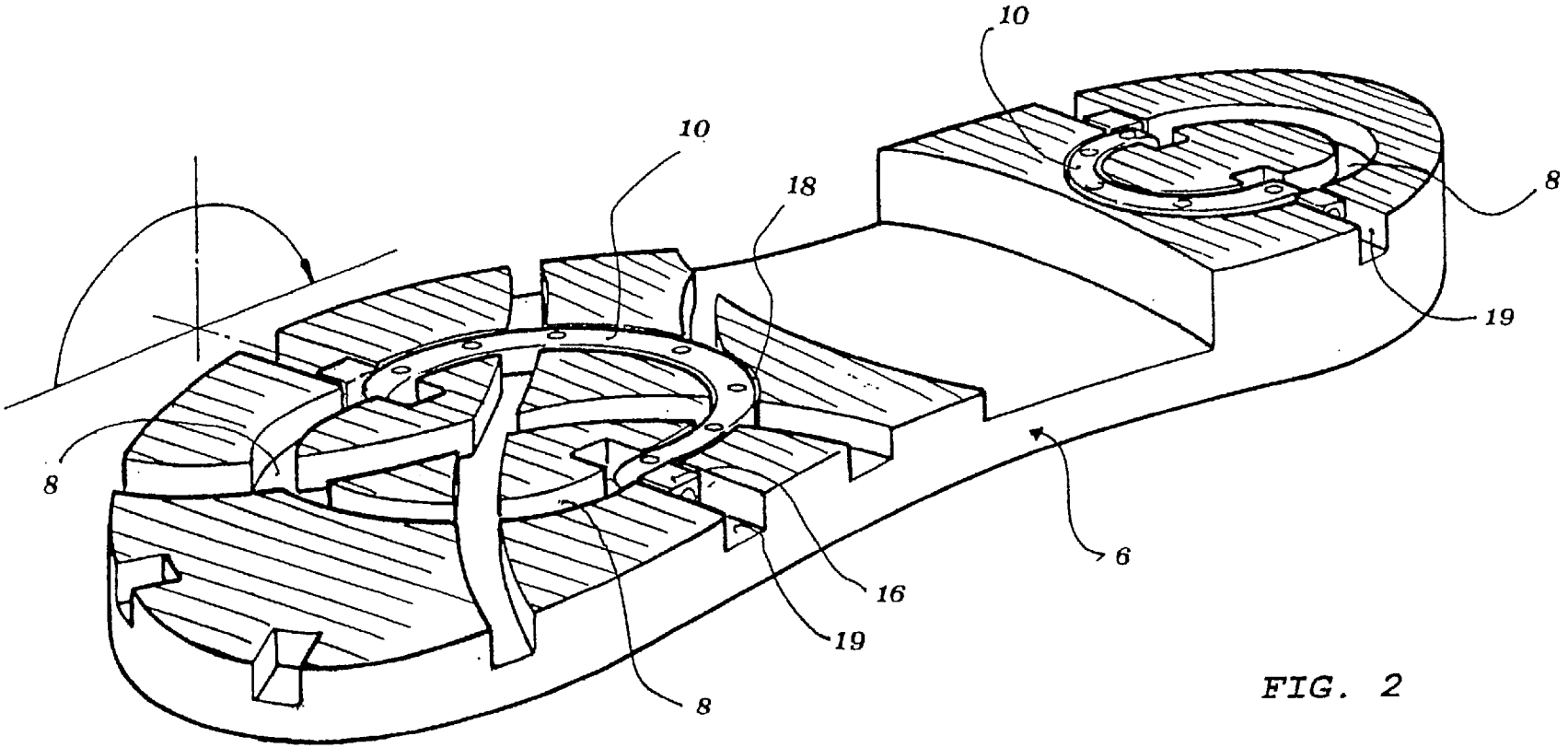
FIG. 2 is the same view as FIG. 1 where the two supports of the spikes are overturned by 180° to bring the spikes within the sole.
Figure 3:
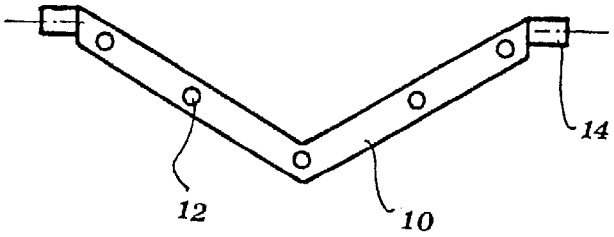
FIGS. 3, 4 and 5 show different embodiments of the supports of the spikes.
Figure 5:
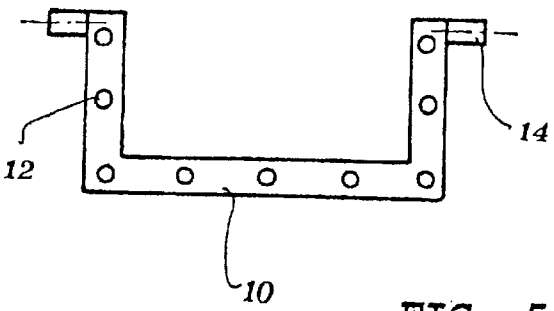
Figure 4:
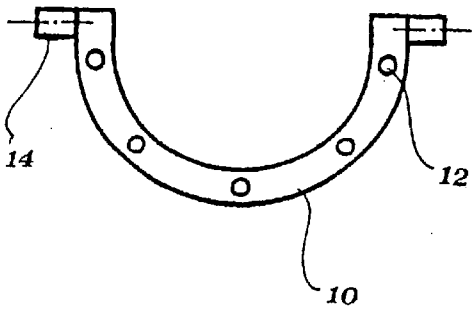

With reference to FIG. 1, anti-slipping sole 6 provided with spikes according to the invention has a plurality of grooves 8 formed in the face of the sole in contact with the ground and capable of receiving small bars 10 with a suitable clearance, such small bars having any shape, for example, a circular arch. The small bars are preferably made of semirigid plastic material and carry a plurality of nails or spikes 12 embedded by moulding therein and arranged all over their length.

Such small arch-shaped bars 10 are provided at both ends with two rotation pins which are snap-fitted into respective rotation sockets 16. Such sockets 16 are formed by rigid cubic blocks provided with a hinge hole and rigidly secured to grooves 19 of the sole placed along the overturning axis of the small arch-shaped bar.

A second groove 18 is located in a mirror-like position with respect to the first groove 8 and differs from the same only because its bottom has recesses 20 for receiving the corresponding spikes 12 of the small arch-shaped bar 10 upon its overturning. With regard to the foregoing the functional capacity of the anti-slipping device of the present invention should be appreciated. The user just needs to overturn the arch-shaped support bars to pass from a smooth sole to be used inside the buildings to a hobnailed sole to be used on slipping surfaces.

Thus, as can be seen in the drawings, the sole has first and second recesses provided by grooves 8, 18 disposed entirely within a ground-contacting side of the sole and being completely surrounded by that ground-contacting side. The support means provided by bars 10 are receivable completely within the grooves 8, 18. The recesses comprised by grooves 8, 18 are U-shaped.

A preferred embodiment of the invention has been described above. It is self-evident, however, that a number of modifications and changes can be made by those skilled in the art without departing from the scope of the present invention as defined in the appended claims. For example, instead of being hinged within the groove, the supports of nails and spikes can be snap-fitted so as to be removed and applied again rotated by 180° to make the face provided with nails or the smooth face alternately visible.

What is claimed is:

1. An anti-slipping shoe sole, having first and second recesses disposed entirely in a ground-contacting side thereof and being completely surrounded by said ground-contacting side, and support means receivable in a first position completely within said first recess and in a second position completely within said second recess, said support means having spikes protruding from one side thereof, said spikes being exposed and projecting out of said first recess when said support means is in said first recess and said spikes extending into said second recess when said support means is in said second recess.

2. A shoe sole as claimed in claim 1, wherein said support means is flush with said ground-contacting side of said shoe sole in said first and second positions.

3. A shoe sole as claimed in claim 1, and pivot means disposed between said first and second recesses whereby said support means is swingable between said first and second positions.

4. A shoe sole as claimed in claim 3, wherein said pivot means are disposed in recesses in said shoe sole and are flush with said ground-contacting side of said shoe sole.

5. A shoe sole as claimed in claim 1, wherein there are said first and second recesses and a said support means and said spikes in a heel of said shoe sole, and said first and second recesses and a said support means and said spikes in a forward portion of said shoe sole.

6. A shoe sole as claimed in claim 1, wherein the portions of said first and second recesses that receive said support means are mirror images of each other.

7. A shoe sole as claimed in claim 1, wherein said first and second recesses are U-shaped and open toward each other.

* * * * *

UNITED STATES PATENT AND TRADEMARK OFFICE

CERTIFICATE OF CORRECTION

PATENT NO. : 6,675,504 B1 
DATED : January 13, 2004
INVENTOR(S) : Demetrio Biancucci and Alfredo Brasca It is certified that error appears in the above-identified patent and that said Letters Patent is hereby corrected as shown below:

Title page,
Item [73], Assignee, should read as follows:
-- [73] Assignee: AL. PI. S.R.L., Civitanova Marche, Italy --.

Signed and Sealed this

Eighteenth Day of May, 2004

JON W. DUDAS
*Acting Director of the United States Patent and Trademark Office*